US006856692B2

(12) United States Patent
Lin

(10) Patent No.: US 6,856,692 B2
(45) Date of Patent: Feb. 15, 2005

(54) COMBINATION SPEAKER ENCLOSURE MOUNTING STRUCTURE

(76) Inventor: Steff Lin, 8Fl., No. 18, Lane 30, Kuo Hsing St., His Chih City, Taipei Hsien (TW)

( * ) Notice: Subject to any disclaimer, the term of this patent is extended or adjusted under 35 U.S.C. 154(b) by 149 days.

(21) Appl. No.: 10/373,742

(22) Filed: Feb. 27, 2003

(65) Prior Publication Data

US 2004/0170295 A1 Sep. 2, 2004

(51) Int. Cl.[7] ..... H04R 1/02
(52) U.S. Cl. ..... 381/395; 381/387; 181/199
(58) Field of Search ..... 181/198, 199; 381/300, 303, 304, 305, 332, 334, 335, 336, 386, 387, 388, 390, 395, 87, 89

(56) References Cited

U.S. PATENT DOCUMENTS 3,720,787 A * 3/1973 Ishii et al. ..... 381/336
4,665,550 A * 5/1987 Haas ..... 381/182
4,953,223 A * 8/1990 Householder ..... 381/387

* cited by examiner

*Primary Examiner*—Curtis Kuntz
*Assistant Examiner*—Brian Ensey
(74) *Attorney, Agent, or Firm*—Bacon & Thomas PLLC

(57) ABSTRACT

A combination speaker enclosure mounting structure includes a plurality of spherical enclosures, each spherical enclosures having two crossed openings at two opposite sides, and two receptacles respectively disposed in the crossed opening, and a plurality of fasteners adapted to secure the spherical enclosures to one another, for enabling the spherical enclosures to be adjusted to the desired angle relative to one another.

3 Claims, 7 Drawing Sheets

COMBINATION SPEAKER ENCLOSURE MOUNTING STRUCTURE

BACKGROUND OF THE INVENTION

1. Field of the Invention

The present invention relates generally to speakers and, more particularly, to a combination speaker enclosure mounting structure, which enables a number of speaker enclosures to be horizontally and/or vertically connected in series.

2. Description of the Related Art

Regular speaker enclosures include square design, rectangular design, as well as spherical design. When linking multiple speaker enclosures, people may simple arrange speaker enclosures in a stack. Further, there are speaker support devices that enable the user to adjust the angular position of the speakers. However, the adjustment is limited to one single direction only.

It is therefore a demand for a combination speaker enclosure mounting structure that enables multiple speaker enclosures to be connected to one another in different directions and freely adjusted to different angular positions.

SUMMARY OF THE INVENTION

The present invention has been accomplished under the circumstances in view. It is the main object of the present invention to provide a combination speaker enclosure mounting structure, which enables multiple speaker enclosures to be connected together horizontally as well as vertically. It is another object of the present invention to provide a combination speaker enclosure mounting structure, which enables the user to adjust the position of the speaker enclosures in different directions.

According to one aspect of the present invention, the combination speaker enclosure mounting structure comprises a plurality of enclosures. Please refer to a spherical shape of enclosure is represented as showing that each spherical enclosures having two crossed openings at two opposite sides, and two receptacles respectively disposed in the crossed opening, and a plurality of fasteners adapted to secure the spherical enclosures to one another, for enabling the spherical enclosures to be adjusted to the desired angle relative to one another. According to another aspect of the present invention, each fastener comprises a first locating plate fastened to one spherical enclosure, a second locating plate fastened to a second spherical enclosure, and a ball supported in a ball socket between the first locating plate and the second locating plate for enabling the joined two spherical enclosures to be turned relative each other to adjust the respective angular position.

DETAILED DESCRIPTION OF THE INVENTION

Figure 1:
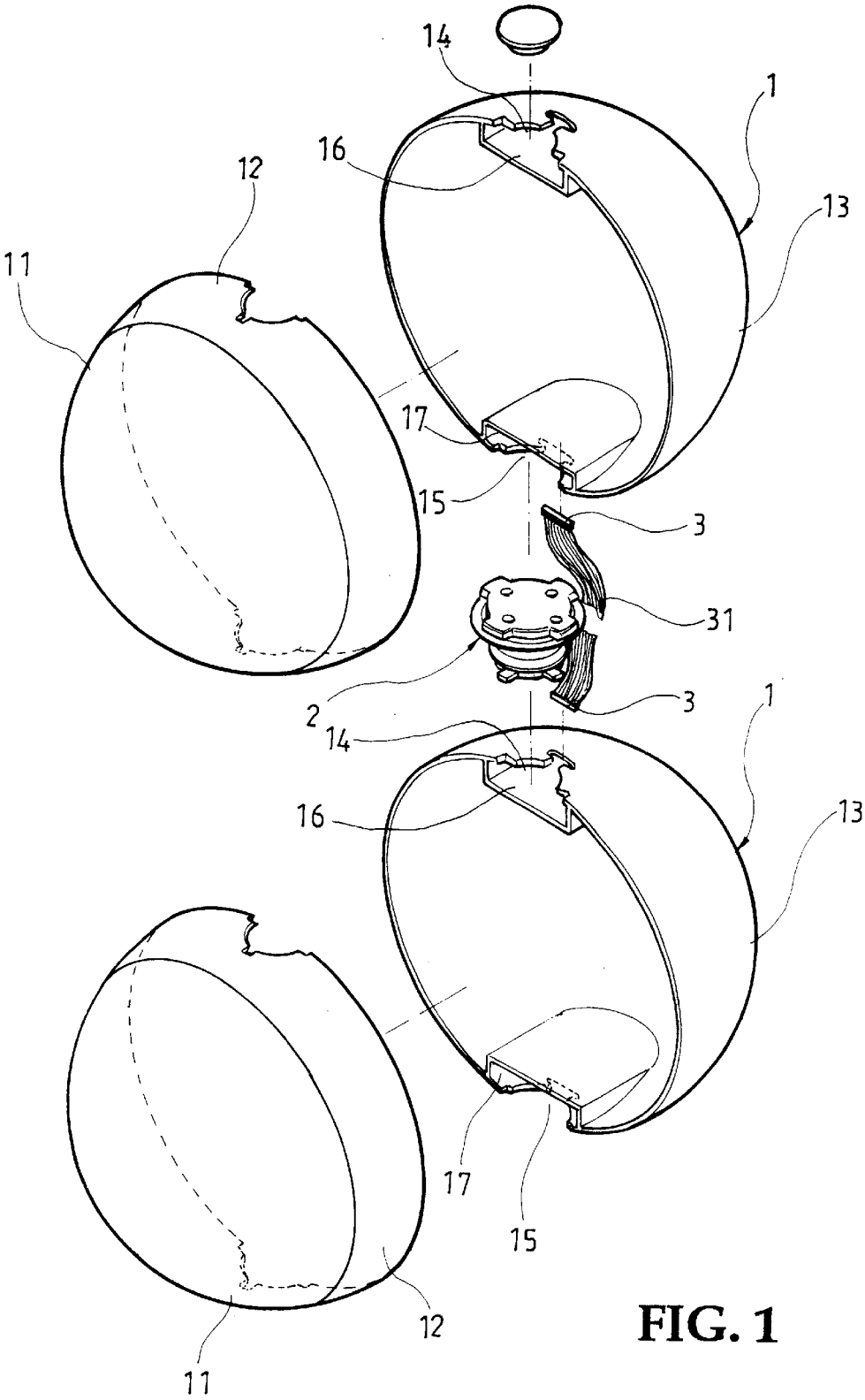
FIG. 1 is an exploded view of a combination speaker enclosure mounting structure according to the present invention.
Figure 2:
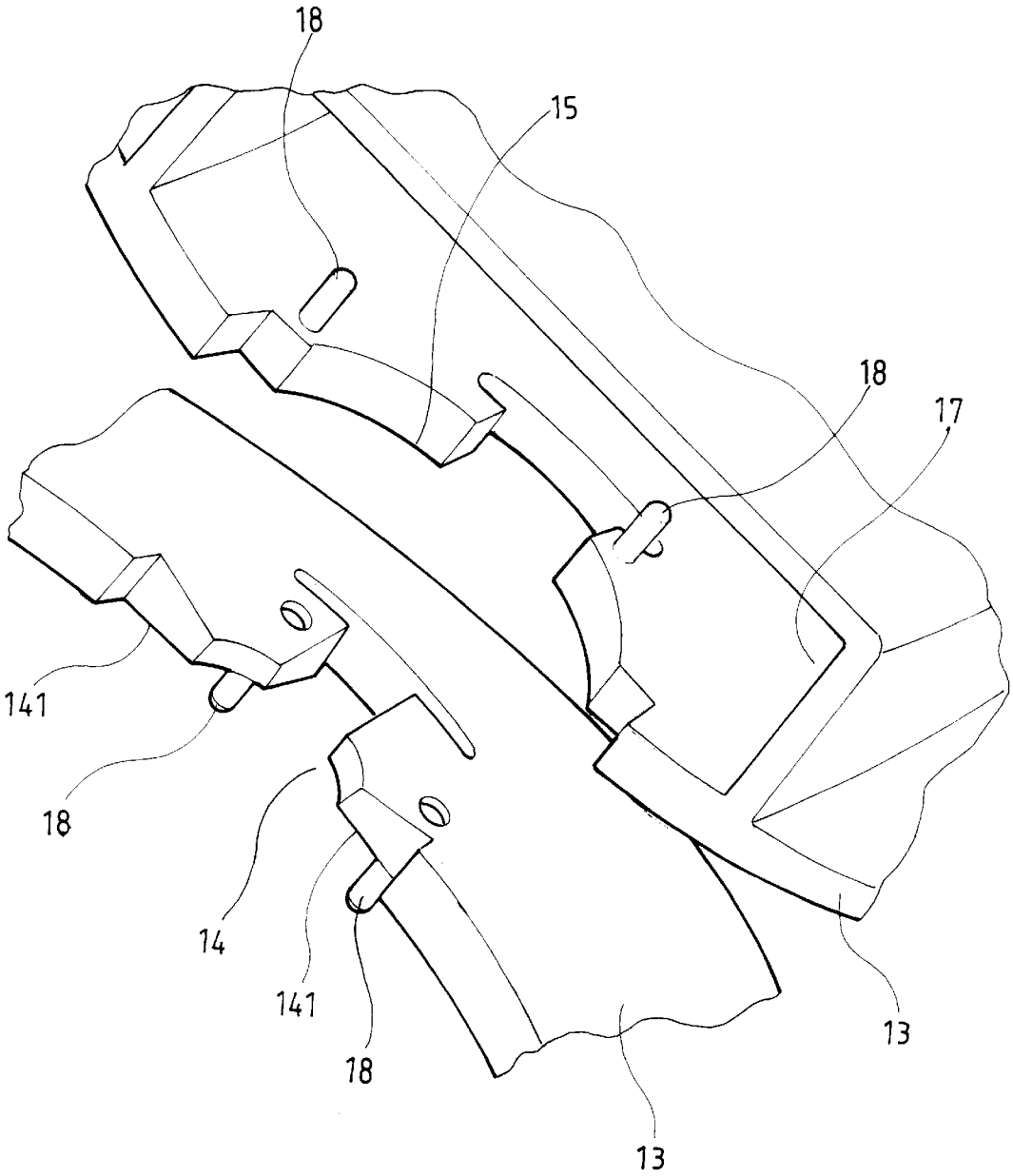
FIG. 2 is a perspective view of a part of the spherical enclosure according to the present invention.
Figure 3:
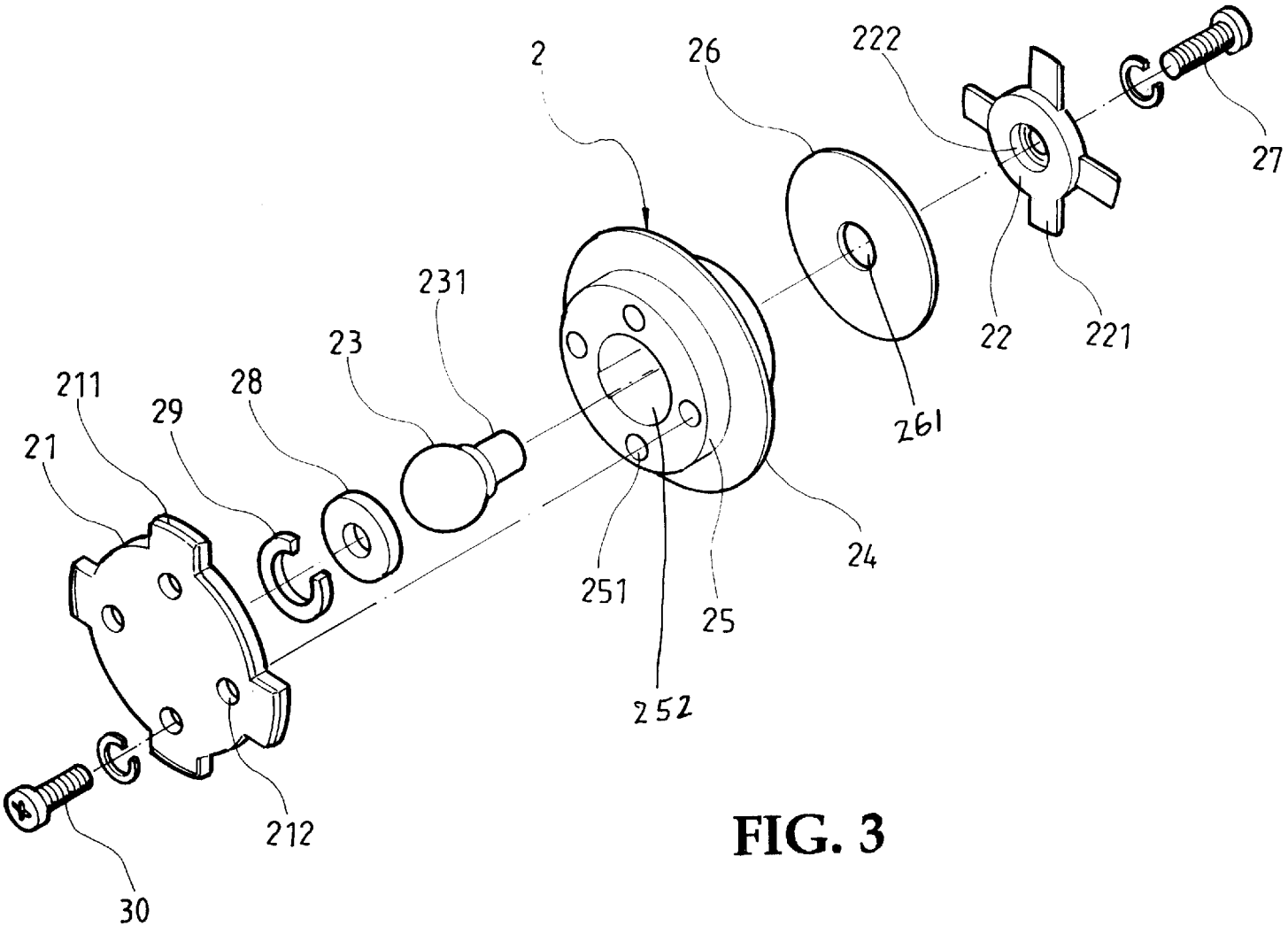
FIG. 3 is an exploded view of the fastener according to the present invention.
Figure 4:
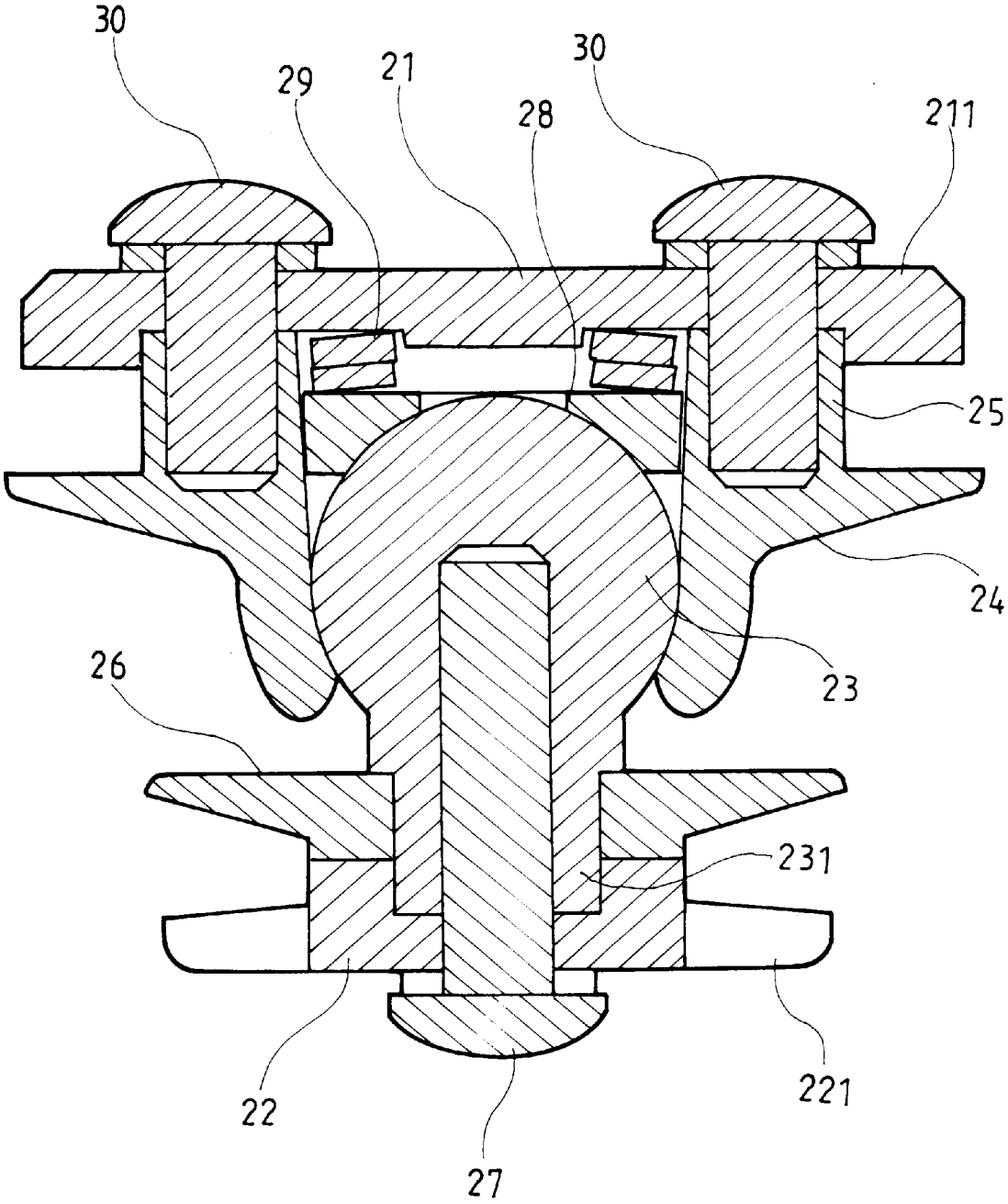
FIG. 4 is a sectional assembly view of the fastener according to the present invention.
Figure 5:
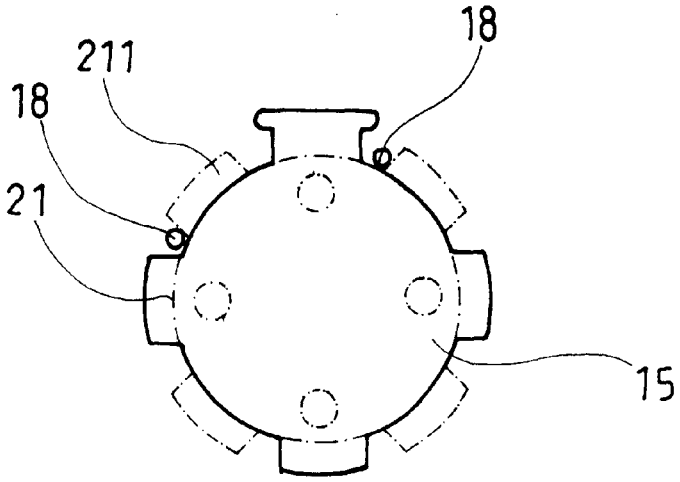
FIG. 5 is a schematic drawing showing the positioning of the locating pegs of the first locating plate relative to the corresponding vertical stop rods according to the present invention.
Figure 5A:
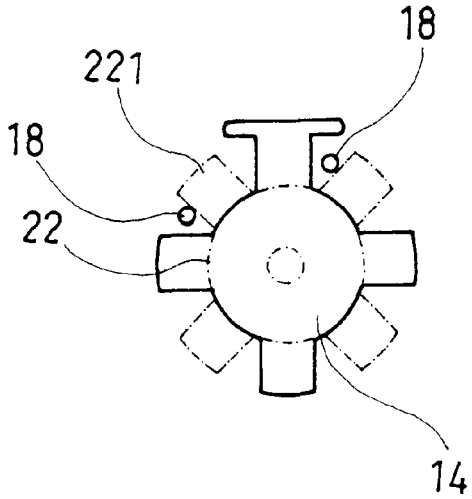
FIG. 5A is a schematic drawing showing the positioning of the locating pegs of the second locating plate relative to the corresponding vertical stop rods according to the present invention.

Referring to FIGS. 1~5, a combination speaker enclosure mounting structure is shown comprised of two spherical enclosures 1 each formed of a meshed member 11, a face panel 12, and a back shell 13, and a fastener 2 joining the spherical enclosures 1. Each spherical enclosure 1 has two crossed openings 14 and 15 formed in the face panel 12 and the back shell 13 at two opposite sides, for example, the top and bottom sides, two receptacles 16 and 17 respectively disposed on the inside corresponding to the crossed openings 14 and 15, a tapered surface portion 141 corresponding to one crossed opening 14, and a plurality of vertical stop rods 18 respectively suspended inside the crossed openings 14 and 15.

The fastener 2 is comprised of a first locating plate 21, which comprises a plurality of locating pegs 211 radially protruded from the periphery and a plurality of axially extended screw holes 212, a second locating plate 22, which comprises a plurality of locating pegs 221 radially protruded from the periphery and an axially extended center screw hole 222, a ball socket 24, which comprises an axially extended center through hole 252, an annular top flange 25 extended around the center through hole 252, and a plurality of mounting holes 251 equiangularly spaced in the annular top flange 25, a ball 23 received in the center through hole 252 of the ball socket 24 between the first locating plate 21 and the second locating plate 22, a washer 26 supported between the second locating plate 22 and the ball socket 24, a fixed stem 231 perpendicularly extended from the periphery of the ball 23 and inserted through the center through hole 261 of the washer 26, a tie screw 27 threaded into the center screw hole 222 of the second locating plate 22 and a bottom screw hole (not shown) of the stem 231 to fix the ball 23, the ball socket 24, the washer 26, and the second locating plate 22 together, a cushion 28 supported between the ball 23 and the first locating plate 21, a spring washer 29 supported between the cushion 28 and the first locating plate 21, and a plurality of tie screws 30 respectively threaded into the screw holes 212 of the first locating plate 21 and the mounting holes 251 of the ball socket 24 to fix the first locating plate 21 to the ball socket 24.

Figure 6:
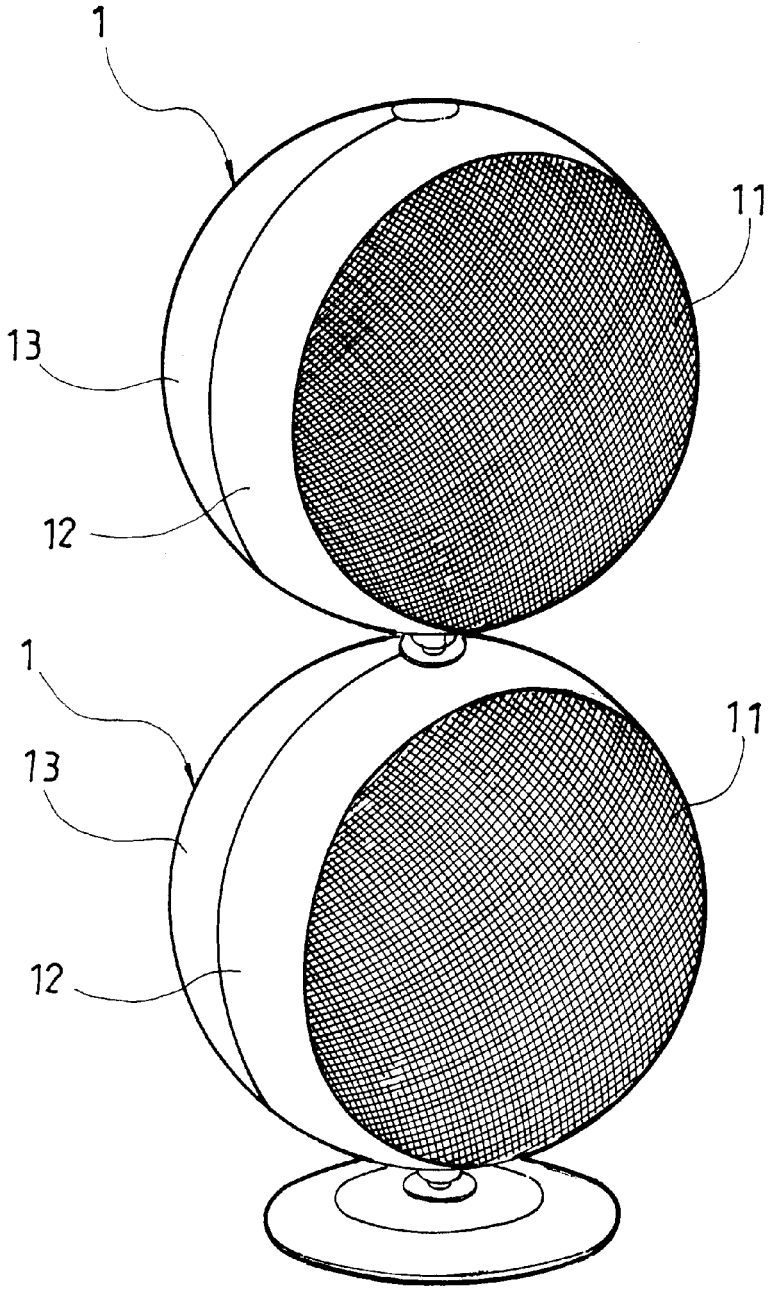
FIG. 6 is a perspective view of one application example of the present invention.
Figure 7:
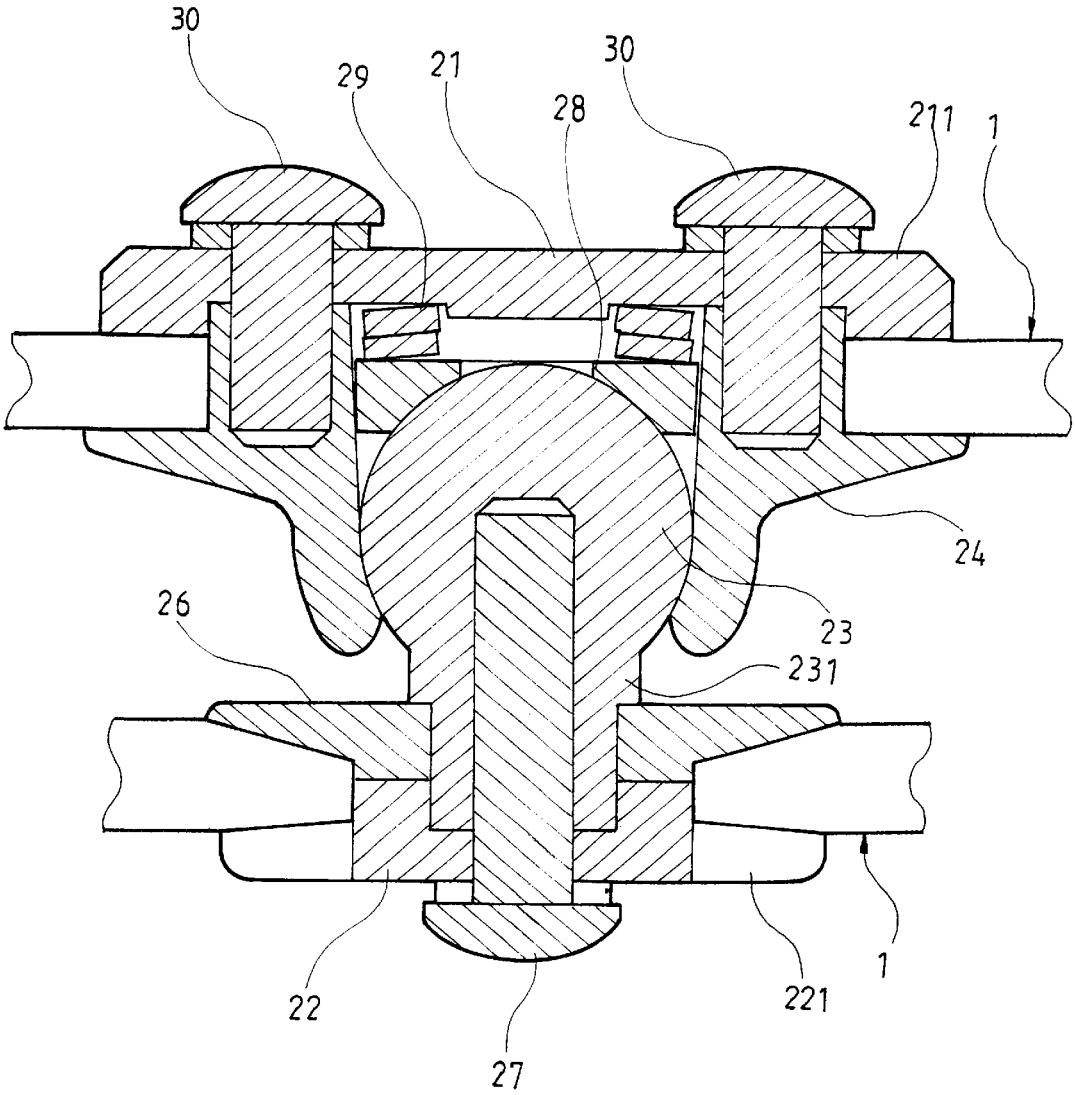
FIG. 7 is a sectional view showing the fastener fastened to the spherical shells according to the present invention.

Referring to FIGS. 6 and 7, the first locating plate 21 and the second locating plate 22 are respectively inserted through the bottom crossed opening 15 of one spherical enclosure 1 and the top crossed opening 14 of a second spherical enclosure 1 into the corresponding receptacles 17 and 16, and then the two spherical enclosures 1 are rotated relative to each other in reversed directions to force the locating plates 21 and 22 into friction engagement with the respective receptacles 17 and 16. When rotating the spherical enclosures 1 relative to each other, the locating pegs 211 and 221 will be stopped at the respective vertical stop rods 18 inside the corresponding crossed openings 14 and 15 to limit the angle of rotation between the spherical enclosures 1. Further, when rotating the spherical enclosures 1 relative to each other, the locating pegs 221 of the second locating plate 22 are moved over the tapered surface portion 141 of the corresponding spherical enclosures 1, thereby causing the fastener 2 to be tightly fastened to the spherical enclosures 1, and therefore the two spherical enclosures 1 are secured together. After installation of speakers (not shown) in the spherical enclosures 1, electric connectors 3 and ribbon cables 31 are installed to link the speakers and to connect the speakers to the audio source. Further, because the ball 23 can be rotated in the ball socket 24, the user can adjust the angular positions of the spherical enclosures 1.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination speaker enclosure mounting structure comprising:

a plurality of spherical enclosures, please refer to a spherical shape of enclosure is represented as showing that each enclosure having two crossed openings at two opposite sides and two receptacles respectively disposed in said crossed openings; and at least one fastener adapted to secure said spherical enclosures to one another, said at least one fastener each comprising a first locating plate inserted trough one crossed opening of one of said spherical enclosures into one receptacle of the corresponding spherical enclosure, said first locating plate comprising a plurality of locating pegs radially protruded from the periphery there for friction-engagement with the corresponding receptacle of the corresponding spherical enclosure and a plurality of axially extended screw holes, a second locating plate inserted through one crossed opening of one of said spherical enclosures into one receptacle of the corresponding spherical enclosure, said second locating plate comprising a plurality of locating pegs radially protruded from the periphery thereof for friction-engagement with the corresponding receptacle of the corresponding spherical enclosure and an axially extended center screw hole, a ball socket, said ball socket comprising an axially extended center through hole, an annular top flange extended around the center through hole of said ball socket, and a plurality of mounting holes equiangularly spaced in said annular top flange, a ball received in the center through hole of said ball socket between said first locating plate and said second locating plate, a washer supported between said second locating plate and said ball socket, an internally threaded stem perpendicularly and fixedly extended from the periphery of said ball and inserted through the center through hole of said washer, a tie screw threaded into the center screw hole of said second locating plate and said internally threaded stem to fix said ball, said ball socket, said washer and said second locating plate together, a cushion supported between said ball and said first locating plate, a spring washer supported between said cushion and said first locating plate, and a plurality of tie screws respectively threaded into the screw holes of said first locating plate and the mounting holes of said ball socket to fix said first locating plate to said ball socket.

2. The combination speaker enclosure mounting structure as claimed in claim 1, wherein said spherical enclosures each comprise a plurality of vertical stop rods respectively suspended inside said crossed openings and adapted to stop the locating pegs of said first locating plate and said second locating plate.

3. The combination speaker enclosure mounting structure as claimed in claim 1, wherein said spherical enclosures each have a tapered surface portion corresponding to one crossed opening for friction engagement with the corresponding fastener.

* * * * *